US005113947A

United States Patent [19]

Robin

[11] Patent Number: 5,113,947

[45] Date of Patent: May 19, 1992

[54] FIRE EXTINGUISHING METHODS AND COMPOSITIONS UTILIZING 2-CHLORO-1,1,1,2-TETRAFLUOROETHANE

[75] Inventor: Mark L. Robin, Lafayette, Ind.

[73] Assignee: Great Lakes Chemical Corporation, W. Lafayette, Ind.

[21] Appl. No.: 488,295

[22] Filed: Mar. 2, 1990

[51] Int. Cl.[5] ..... A62C 5/00; A62C 39/00; A62D 1/08

[52] U.S. Cl. ..... 169/46; 252/2; 252/3; 252/8

[58] Field of Search ..... 252/2, 3, 8; 169/46

[56] References Cited

U.S. PATENT DOCUMENTS

| | | | |
|---|---|---|---|
| 1,103,092 | 7/1914 | Snelling | 252/8 |
| 2,021,981 | 6/1930 | Bichowsky | 23/12 |
| 3,479,286 | 11/1969 | Paolo | 252/8 |
| 3,715,438 | 2/1973 | Hugget | 424/366 |
| 3,733,273 | 5/1973 | Munro | 252/1 |
| 3,844,354 | 10/1974 | Larsen | 169/46 |
| 4,459,213 | 7/1984 | Uchida et al. | 252/8.05 |
| 4,954,271 | 9/1990 | Green | 252/8 |

FOREIGN PATENT DOCUMENTS

| | | | |
|---|---|---|---|
| 0383443 | 8/1990 | European Pat. Off. | 169/46 |
| 1368443 | 9/1974 | United Kingdom . | |

*Primary Examiner*—Richard D. Lovering
*Assistant Examiner*—Joseph D. Anthony
*Attorney, Agent, or Firm*—Woodard, Emhardt, Naughton, Moriarty & McNett

[57] ABSTRACT

Methods for extinguishing fires are disclosed which include the use of 2-Chloro-1,1,1,2-tetrafluoroethane as a fire extinguishing agent. The 2-Chloro-1,1,1,2-tetrafluoroethane may be used alone or in combination with other halogenated hydrocarbon fire extinguishants. Compositions including the 2-Chloro-1,1,1,2-tetrafluoroethane and other extinguishants are also disclosed. The compositions are effective at low concentrations and are non-toxic and environmentally safe.

12 Claims, No Drawings

FIRE EXTINGUISHING METHODS AND COMPOSITIONS UTILIZING 2-CHLORO-1,1,1,2-TETRAFLUOROETHANE

BACKGROUND OF THE INVENTION

1. Field of the Invention

The present invention relates to the field of fire extinguishing compositions and methods using halogenated hydrocarbons.

2. Description of the Prior Art

The use of certain halogenated chemical agents for the extinguishment of fires is common. These agents are thought to be effective due to their interference with the normal chain reactions responsible for flame propagation. The most widely accepted mechanism for flame suppression is the radical trap mechanism proposed by Fryburg in *Review of Literature Pertinent to Fire Extinguishing Agents and to Basic Mechanisms Involved in Their Action,* NACA-TN 2102 (1950). It is generally accepted that compounds containing the halogens Cl, Br and I act by interfering with free radical or ionic species in the flame, and that the effectiveness of these halogens is in the order I>Br>Cl. The presence of fluorine has not been considered as contributing to the fire extinguishing properties of a compound, but will impart stability, reduce toxicity and boiling point and increase thermal stability.

Various halogenated hydrocarbons have been used or proposed for use as fire extinguishants. Prior to 1945, three halogenated fire extinguishing agents widely used were carbon tetrachloride (Halon 104), methyl bromide (Halon 1001) and chlorobromomethane (Halon 1011). For toxicological reasons, however, the use of these agents has been discontinued. The three fire extinguishing agents presently in common use are bromine-containing compounds, Halon 1301 ($CF_3Br$), Halon 1211 ($CF_2BrCl$) and Halon 2402 ($CF_2BrCF_2Br$). The effectiveness of these three volatile, bromine-containing compounds in extinguishing fires has been described in U.S. Pat. No. 4,014,799, issued to Owens. In addition, the use of dibromodifluoromethane, Halon 1202 ($CF_2Br_2$), has been reported, although the compound is highly toxic. The NFPA publication, the *Fire Protection Handbook,* Section 18, Chapter 2, entitled "Halogenated Agents and Systems" (1985) describes these agents in more detail.

Although the above named bromine-containing Halons are effective fire fighting agents, those agents containing bromine or chlorine are asserted by some to be capable of the destruction of the earth's protective ozone layer. For example, Halon 1301 has an Ozone Depletion Potential (ODP) rating of 14.26, and Halon 1211 has an ODP of 2.64. Also, because the agents contain no hydrogen atoms which would permit their destruction in the troposphere, the agents may also contribute to the greenhouse warming effect.

Although not employed commercially, certain chlorine-containing compounds are also known to be effective extinguishing agents, for example Halon 251 ($CF_3CF_2Cl$), as described by Larsen in U.S. Pat. No. 3,844,354. The use of trichlorofluoromethane ($CFCl_3$) with all or any of dichlorodifluoromethane ($CCl_2F_2$), trichlorotrifluoroethane ($CCl_2F$-$CClF_2$) or dichlorotetrafluoroethane ($CClF_2$-$CClF_2$) in fire extinguishers is disclosed in U.S. Pat. No. 4,826,610, issued to Thacker on May 2, 1989. In U.S. Pat. No. 3,733,273, issued to Munro on May 15, 1973, it is disclosed that an azeotropic mixture of 1,2-dichloro-1,1,2,2-tetrafluoroethane and 1-chloro-1,2,2-trifluoroethane is useful as a fire extinguishing agent. Various other halogenated fire extinguishing agents have been disclosed in the prior art, including in U.S. Pat. Nos. 4,606,832, issued to Hisamoto et al. on Aug. 19, 1986; 3,879,297, issued to Languille et al. on Apr. 22, 1975; 3,822,207, issued to Howard et al. on Jul. 2, 1974; 3,080,430, issued to Cohen on Mar. 5, 1963; and, 4,226,728, issued to Kung on Oct. 7, 1980.

Several factors enter into the selection and use of halogenated hydrocarbons as fire extinguishants. As already mentioned, brominated hydrocarbons in particular present concerns with ozone depletion. Compounds which do not include bromine tend to be ineffective at safe levels, or toxic at effective levels. It has therefore remained desirable to provide fire extinguishants which satisfy the various criteria applicable for use of these compounds. In particular, there continues to be a need for fire extinguishing agents which are effective and non-toxic, and which have low ozone depletion ratings and minimal impact on the greenhouse warming effect.

The present invention involves the use of 2-Chloro-1,1,1,2-tetrafluoroethane as a fire extinguishant, either alone or in combination with other compounds. This compound is commonly known as Freon 124. Applicant has discovered that this compound has surprising efficacy at safe concentrations. Although the compound is well known, it has not been proposed for use as a fire extinguishant. Instead, Freon 124 has only been indicated in the past as being useful as a propellant or refrigerant.

SUMMARY OF THE INVENTION

Briefly describing one aspect of the present invention, there is provided a method for extinguishing a fire which comprises introducing to the fire a fire extinguishing concentration of an extinguishant composition including 2-Chloro-1,1,1,2-tetrafluoroethane, and maintaining the concentration of the composition until the fire is extinguished. The 2-Chloro-1,1,1,2-tetrafluoroethane may be used alone, or in combination with other halogenated hydrocarbon fire extinguishants. Blends of 2-Chloro-1,1,1,2-tetrafluoroethane with such other extinguishants are also contemplated.

It is an object of the present invention to provide an effective method for extinguishing fires.

Another object of the present invention is to provide a fire extinguishing method which utilizes particular halogenated hydrocarbons, including specifically 2-Chloro-1,1,1,2-tetrafluoroethane, which are effective at non-toxic and non-anesthetic levels.

It is a further object of the present invention to provide a fire extinguishing method which employs compounds that are environmentally safe, having low ozone depletion potential and greenhouse warming effect.

A further object of the present invention is to provide fire extinguishing compositions comprising blends of 2-Chloro-1,1,1,2-tetrafluoroethane and other halogenated hydrocarbons, which blends are effective and safe in use.

Further objects of the present invention will be apparent from the description which follows.

DESCRIPTION OF THE PREFERRED EMBODIMENT

For the purposes of promoting an understanding of the principles of the invention, reference will now be made to preferred embodiments of the invention and specific language will be used to describe the same. It will nevertheless be understood that no limitation of the scope of the invention is thereby intended, such alterations, further modifications and applications of the principles of the invention as described herein being contemplated as would normally occur to one skilled in the art to which the invention relates.

The present invention provides methods and compositions which are useful for extinguishing fires, and which particularly are safe and effective in use. In one aspect, the invention relates to methods for fire extinguishing which are improved by using 2-Chloro-1,1,1,2-tetrafluoroethane, alone or in a blend, as the fire extinguishing agent. The 2-Chloro-1,1,1,2-tetrafluoroethane is environmentally safe and is non-toxic and non-anesthetic at effective levels. The invention also relates to the provision of fire extinguishing compositions comprising blends of 2-Chloro-1,1,1,2-tetrafluoroethane with other halogenated hydrocarbon fire extinguishants.

2-Chloro-1,1,1,2-tetrafluoroethane ($CF_3CHFCl$) is a halogenated hydrocarbon commonly known as Freon 124. It has a molecular weight of 136.48 and a boiling point of $-12°$ C. Prior to this invention, Freon 124 has been used as a propellant or refrigerant, and its use in these regards is described in numerous prior art publications, including U.S. Pat. Nos. 4,224,795, 4,172,043, and 4,072,027.

Methods for the preparation of 2-Chloro-1,1,1,2-tetrafluoroethane are known in the prior art. For example, 2-Chloro-1,1,1,2-tetrafluoroethane may be prepared by fluorination of $CCl_2=CCl_2$ with HF, as described in European Patent Application No. 313,061 (1989). An alternative preparation is by reaction of $CF_2=CFCl$ with KF/formamide, as reported in the Journal of the American Chemical Society, vol. 82, p. 3091 (1960).

In accordance with one embodiment of the present invention, there is provided a method for extinguishing fires which includes the use of 2-Chloro-1,1,1,2-tetrafluoroethane as a fire extinguishing agent. The 2-Chloro-1,1,1,2-tetrafluoroethane may be applied in the variety of ways employed for other halogenated hydrocarbons, including application in flooding systems, portable systems and specialized systems, described hereafter in more detail. 2-Chloro-1,1,1,2-tetrafluoroethane is effective in low concentrations, and of course at high concentrations as well. The concentration employed may depend to some extent on the nature of the fire, the combusting material and the circumstances of application. Generally, application rates of 2-Chloro-1,1,1,2-tetrafluoroethane alone preferably range from about 1% to about 15% v/v, and more preferably between about 3% and about 10% v/v.

A particular consideration in selecting a concentration for the 2-Chloro-1,1,1,2-tetrafluoroethane is the maintenance of the area in a non-toxic and non-anesthetic condition. A 50% lethal dose (LD 50) for a compound is that concentration of the compound (volume of compound per volume of air) at which 50% of a test population is killed; a 50% anesthetic dose (AD 50) is that concentration at which 50% of a test population is anesthetized. 2-Chloro-1,1,1,2-tetrafluoroethane has an LD50 of 44.7% v/v, and an AD50 of 15.5% v/v, as reported by Davies, et al., Int. J. Quantum Chem: Quantum Biology Symp No. 3, 171 (1976). Selection of the appropriate usage rate will be affected by these properties. For example, a usage rate where humans may be present is below about 15% v/v, and more preferably below about 10% v/v.

A further desirable aspect of the present invention is that 2-Chloro-1,1,1,2-tetrafluoroethane is environmentally safer than many of the prior art halogenated hydrocarbon fire extinguishants. 2-Chloro-1,1,1,2-tetrafluoroethane has an ODP of 0.018, as compared to an ODP of 14.26 for Halon 1301 and of 2.64 for Halon 1211, two common commercial fire extinguishants. It is believed that the presence of the hydrogen in 2-Chloro-1,1,1,2-tetrafluoroethane makes the compound less stable and contributes to the lower ODP, since the molecules are susceptible to breakdown in the lower atmosphere. It will be appreciated that the substitution of 2-Chloro-1,1,1,2-tetrafluoroethane for prior art compounds having a higher ODP will greatly reduce the ozone depletion potential of the overall composition.

It is also an aspect of the present invention that 2-Chloro-1,1,1,2-tetrafluoroethane may be employed with other extinguishants to provide a blend having improved characteristics in terms of efficacy, toxicity and/or environmental safety. As previously reported, various halogenated hydrocarbons have been used or proposed in the prior art for use as fire extinguishants. These extinguishants include bromodifluoromethane ($CHF_2Br$ - Halon 1201), dibromodifluoromethane ($CF_2Br_2$ - Halon 1202), bromotrifluoromethane ($CF_3Br$ - Halon 1301), bromochlorodifluoromethane ($CF_2BrCl$-Halon 1211), chloropentafluoroethane ($CF_3CF_2Cl$ - Halon 251), dibromotetrafluoroethane ($CF_2BrCF_2Br$ - Halon 2402), bromotetrafluoroethane ($CF_3CHFBr$), and mixtures thereof. 2-Chloro-1,1,1,2-tetrafluoroethane may be combined, preferably in an amount of from about 1% to about 99%, with one or more of these extinguishants and employed in a method for extinguishing fires.

As will be seen from the examples which follow, the mixtures of 2-Chloro-1,1,1,2-tetrafluoroethane with bromodifluoromethane are especially attractive due to their low ODP. Also, the similarity of boiling points for the two compounds allows the composition discharged or otherwise applied to remain essentially constant. Blends having from about 5% to about 99% Freon 124 and from about 95% to about 1% bromodifluoromethane are particularly preferred.

One of the surprising and advantageous aspects of the present invention is that the 2-Chloro-1,1,1,2-tetrafluoroethane has been found to be effective at low concentrations, even though the compound does not include bromine. By contrast, it has previously been considered that the most effective halogenated fire extinguishants have been limited to those which contain bromine, and which are fully halogenated. It has also recently been discovered by applicant and a co-worker that heptafluoropropane ($CF_3CHFCF_3$), 1,1,1,3,3,3-Hexafluoropropane ($CF_3CH_2CF_3$), 1,1,1,2,3,3-Hexafluoropropane ($CF_3CHFCHF_2$) and pentafluoroethane ($CF_3CHF_2$) are useful fire extinguishants, as disclosed in co-pending United States patent application Ser. No. 439,738, filed on Nov. 21, 1989. 2-Chloro-1,1,1,2-tetrafluoroethane has been determined to be effective in blends with these four compounds.

As demonstrated in the subsequent examples, mixtures of 2-Chloro-1,1,1,2-tetrafluoroethane with $CF_3CHFCF_3$ are especially valuable. The mixtures have ultra low ODP and exhibit a large synergistic effect. Such mixtures extinguish a flame at total percent of agents in air less than that of either agent when used alone. Also, the total weight of mixtures to extinguish is less than that of either agent when used alone. Blends having from about 5% to about 99% Freon 124 and from about 95% to about 1% $CF_3CHFCF_3$ are particularly preferred.

The relative amounts of the 2-Chloro-1,1,1,2-tetrafluoroethane and other compounds is not critical, but rather is dictated by the characteristics desired for the overall composition. Thus, in certain applications there may be a greater need for low toxicity, indicating a higher percent of 2-Chloro-1,1,1,2-tetrafluoroethane. In other instances, the emphasis may be on high efficacy, and less 2-Chloro-1,1,1,2-tetrafluoroethane may be desired. Therefore, no particular ratios of compounds are required. However, for certain applications, blends containing at least about 1% of 2-Chloro-1,1,1,2-tetrafluoroethane, and more particularly from about 5% to about 99% 2-Chloro-1,1,1,2-tetrafluoroethane, are desirable.

A particularly desirable aspect of the present invention is that the use of 2-Chloro-1,1,1,2-tetrafluoroethane, which has an extremely low ODP, permits the preparation of blends with other extinguishants that have a significantly lower ODP than the compounds have without the 2-Chloro-1,1,1,2-tetrafluoroethane. Thus, a feature of the present invention is the preparation and use of blends having an overall ODP of less than about 1.0, and more preferably less than about 0.5.

Along these lines, 2-Chloro-1,1,1,2-tetrafluoroethane may be used as a partial replacement for halogenated hydrocarbons otherwise used in fire extinguishing compositions. In other words, for a composition including two or more of the prior art extinguishants, 2-Chloro-1,1,1,2-tetrafluoroethane may be used to partially or fully substitute for one of those compositions. This has the advantage of modifying the overall characteristics of the blend, such as by reducing ODP or toxicity. The 2-Chloro-1,1,1,2-tetrafluoroethane is therefore seen to be extremely flexible in its manner of use as a fire extinguishant.

The methods for application of the described fire extinguishing compositions are those known to be useful for similar halogenated hydrocarbons. In broad terms, these methods utilize application systems which typically include a supply of agent, a means for releasing or propelling the agent from its container, and one or more discharge nozzles to apply the agent into the hazard or directly onto the burning object. A system may also contain other elements, such as one or more detectors, remote and local alarms, a piping network, mechanical and electrical interlocks to shut down ventilation, etc., directional control valves, etc. Such systems may be stationary or portable, and typically the fire extinguishant may be pressurized with nitrogen or other inert gas at up to about 600 psig at ambient temperature.

Systems are broadly classified by their method of applying agent to the hazard. In total flooding systems, a sufficient quantity of extinguishing agent is discharged into an enclosure to provide a fire extinguishing concentration of agent throughout the enclosure. Total flooding systems are used, for example, for computer rooms, control rooms, special storage areas, machinery spaces and the like. Local application systems discharge fire extinguishing agent in such a manner that the burning object is surrounded locally by a high concentration of agent to extinguish the fire. Local systems are often employed because the enclosure may not be suitable to provide for total flooding. Examples include use for presses, tanks, spray booths, and electric transformers. Specialized systems are frequently used for specific applications or hazards, such as for aircraft, military vehicles, emergency generators, etc.

In the methods of the present invention, the level of usage is selected to give a fire extinguishing amount of fire extinguishant based on the particular composition chosen, the nature of the fire and burning material, the physical conditions surrounding the fire, etc. The methods may employ the fire extinguishing agents at essentially any concentrations at which fire may be extinguished, the exact minimum being dependent on factors such as the foregoing ones. A convenient minimum level of usage is about 3% v/v. Preferred concentrations of the fire extinguishing composition are below about 15%, and more preferably from about 5% to about 10% v/v, although higher concentrations naturally will be effective.

The 2-Chloro-1,1,1,2-tetrafluoroethane, and other extinguishants if present, may be mixed with suitable propellants to facilitate application of the composition to a fire. Such propellants will include nitrogen, carbon tetrafluoride and $CF_3H$. Other compatible propellants or other compounds may also be mixed with the fire extinguishants of the present invention.

One of the notable advantages of 2-Chloro-1,1,1,2-tetrafluoroethane is the combination of efficacy, nontoxicity and low ODP. Prior art fire extinguishants typically are less desirable as to one or more of these properties. 2-Chloro-1,1,1,2-tetrafluoroethane is therefore a superior fire extinguishant in appropriate settings. By comparison, known extinguishants such as Halon 1301 and 1211 are more effective on a weight basis, but their ODP's are substantially higher than for 2-Chloro-1,1,1,2-tetrafluoroethane, rendering them environmentally unacceptable. The 2-Chloro-1,1,1,2-tetrafluoroethane compositions of the present invention have reduced ODP ratings, but are surprisingly effective at levels safe to humans, i.e. particularly at concentrations less than about 10%.

The invention will be further described with reference to the following specific Examples. However, it will be understood that these Examples are illustrative and not restrictive in nature. In the following Examples, percents indicated are percents by weight unless indicated otherwise.

EXAMPLE 1

Dynamic flame extinguishing data for 2-Chloro-1,1,1,2-tetrafluoroethane were obtained using the cup burner test procedure with n-heptane as the fuel. Gaseous 2-Chloro-1,1,1,2-tetrafluoroethane was mixed with air and introduced to the flame, with the concentration of the agent being slowly increased until the flow was just sufficient to cause extinction of the flame. Data were also obtained in this manner for Halon 1301 ($CF_3Br$), Halon 1211 ($CF_2BrCl$), and CF4 for comparative purposes. The percent of each agent added to air required to extinguish the flame is given in Table 1. As is apparent from these results, 2-Chloro-1,1,1,2-tetrafluoroethane has a much lower ODP at its extinguishing concentration than does $CF_3Br$ or $CF_2BrCl$, even though the latter two required less concentration to extinguish the flame. The extinguishing concentration for each of these three compounds was well below 10% v/v. Although $CF_4$ has a zero ODP, the required extinguishing concentration was an unacceptable 16.5% v/v.

EXAMPLE 2

2-Chloro-1,1,1,2-tetrafluoroethane, Halon 1301, Halon 1211 and CF4 were used to extinguish n-butane diffusion flames using the method of Example 1. Test data are reported in Table 2 and similar results as for Example 1 were obtained.

TABLE 1

Extinguishment of n-Heptane Diffusion Flames

| Agent | Air Flow cc/min | Agent Required cc/min | Agent Required mg/L | Agent in Air, % added* | ODP |
|---|---|---|---|---|---|
| CF3CHFCl | 16,200 | 1,166 | 400 | 7.2 | 0.018 |
| CF3Br | 16,200 | 422 | 158 | 2.6 | 14.26 |
| CF2BrCl | 16,200 | 437 | 182 | 2.7 | 2.64 |
| CF4 | 16,200 | 2,668 | 593 | 16.5 | 0.00 |

Agent required mg/L = $\frac{\text{mg agent at extinguishment}}{\text{L Air}}$

Agent in air, % added = $\frac{\text{cc/min agent at extinguishment}}{\text{cc/min air}} \times 100$ ODP = calculation by Lawrence Livermore Research Laboratory (ozone depletion potential)

TABLE 2

Extinguishment of n-Butane Diffusion Flames

| Agent | Air Flow cc/min | Agent Required cc/min | Agent Required mg/L | Agent in Air, % added* | ODP |
|---|---|---|---|---|---|
| CF3CHFCl | 14,500 | 911 | 350 | 6.3 | 0.018 |
| CF3Br | 14,500 | 282 | 116 | 1.9 | 14.26 |
| CF2BrCl | 14,500 | 344 | 162 | 2.4 | 2.64 |

TABLE 2-continued

Extinguishment of n-Butane Diffusion Flames

| Agent | Air Flow cc/min | Agent Required cc/min | Agent Required mg/L | Agent in Air, % added* | ODP |
|---|---|---|---|---|---|
| CF4 | 14,500 | 1,961 | 485 | 13.5 | 0.00 |

n-Butane flow = 100 cc/min

Agent required mg/L = $\frac{\text{mg agent}}{\text{L Air}}$

Agent in air, % added = $\frac{\text{cc/min agent at extinguishment}}{\text{cc/min air}} \times 100$ ODP = calculation by Lawrence Livermore Research Laboratory

EXAMPLE 3

Dynamic flame extinguishing data using the cup burner method of Example 1 were obtained for various mixtures of 2-Chloro-1,1,1,2-tetrafluoroethane and Halon 1301. Air and a mixture of the agents were continuously supplied to an n-heptane diffusion flame produced in a glass cup burner. For a given Freon 124 flow, the flow of Halon 1301 was slowly increased until the flow was just sufficient to cause extinction of the flame. The experiment was repeated at various Freon 124 flow rates, and the results are reported in Table 3.

EXAMPLES 4–7

Tables 4–7 report diffusion flame extinguishment results obtained using the method of Example 3 for the following agent mixtures:

Table 4—Freon 124 and Halon 1211
Table 5—Freon 124 and Halon 1201
Table 6—Freon 124 and CF3CHFCF3
Table 7—Freon 124 and CF4

These Tables also contain ODP data for the blends, calculated as the sum of the mole % of the agents multiplied by the agents ODP. For example, a 50:50 mole percent mixture of Freon 124 and Halon 1301 has a calculated ODP of $(0.5\times0.018)+(0.5\times14.26)=7.14$.

TABLE 3

Extinguishment of n-Heptane Diffusion Flames
CF3CHFCl/CF3Br Mixtures

| CF3CHFCl* mol % | CF3CHFCl* wt % | CF3CHFCl % added | CF3Br % added | Total % added | CF3CHFCl mg/L | CF3Br mg/L | Total mg/L | ODP |
|---|---|---|---|---|---|---|---|---|
| 0 | 0 | 0 | 2.6 | 2.6 | 0 | 158 | 158 | 14.26 |
| 36.0 | 34.0 | 1.1 | 2.0 | 3.1 | 63 | 122 | 185 | 9.13 |
| 62.5 | 60.3 | 2.4 | 1.5 | 3.9 | 136 | 89 | 225 | 5.36 |
| 79.6 | 78.1 | 3.7 | 0.9 | 4.6 | 205 | 57 | 262 | 2.92 |
| 90.4 | 89.5 | 4.9 | 0.5 | 5.4 | 271 | 32 | 303 | 1.38 |
| 97.0 | 96.7 | 6.0 | 0.2 | 6.2 | 334 | 11 | 345 | 0.45 |
| 100 | 100 | 7.2 | 0.0 | 7.2 | 400 | 0 | 400 | 0.018 |

% added = $\frac{\text{cc/min agent at extinguishment}}{\text{cc/min air}} \times 100$ mg/L = $\frac{\text{mg agent at extinguishment}}{\text{L air}}$

*remainder $CF_3Br$

TABLE 4

Extinguishment of n-Heptane Diffusion Flames
CF3CHFCl/CF2BrCl Mixtures

| CF3CHFCl mol % | CF3CHFCl wt % | CF3CHFCl % added | CF2BrCl % added | Total % added | CF3CHFCl mg/L | CF2BrCl mg/L | Total mg/L | ODP |
|---|---|---|---|---|---|---|---|---|
| 0 | 0 | 0 | 2.7 | 2.7 | 0 | 182 | 182 | 2.64 |
| 33.9 | 29.7 | 1.1 | 2.2 | 3.3 | 63 | 149 | 212 | 1.75 |
| 58.8 | 54.1 | 2.4 | 1.7 | 4.1 | 136 | 115 | 251 | 1.10 |
| 76.8 | 73.1 | 3.7 | 1.1 | 4.8 | 205 | 75 | 280 | 0.63 |
| 91.7 | 90.0 | 4.9 | 0.4 | 5.3 | 271 | 30 | 301 | 0.24 |
| 97.1 | 96.5 | 6.0 | 0.2 | 6.2 | 334 | 12 | 346 | 0.09 |
| 100 | 100 | 7.2 | 0.0 | 7.2 | 400 | 0 | 400 | 0.018 |

TABLE 5

| Extinguishment of n-Heptane Diffusion Flames CF3CHFC1/CF2HBr Mixtures | | | | | | | | |
|---|---|---|---|---|---|---|---|---|
| CF3CHFC1 | | CF3CHFC1 | CF2HBr | Total | CF3CHFC1 | CF2HBr | Total | |
| mol % | wt % | % added | % added | % added | mg/L | mg/L | mg/L | ODP |
| 0 | 0 | 0 | 3.2 | 3.2 | 0 | 174 | 174 | 0.89 |
| 29.0 | 29.7 | 1.1 | 2.8 | 3.9 | 63 | 149 | 212 | 0.64 |
| 56.8 | 57.7 | 2.4 | 1.9 | 4.3 | 136 | 99 | 235 | 0.39 |
| 76.1 | 76.8 | 3.7 | 1.2 | 4.9 | 205 | 62 | 267 | 0.23 |
| 84.1 | 84.6 | 4.9 | 0.9 | 5.8 | 271 | 50 | 321 | 0.16 |
| 94.4 | 94.6 | 6.0 | 0.4 | 6.4 | 334 | 19 | 353 | 0.07 |
| 100 | 100 | 7.2 | 0.0 | 7.2 | 400 | 0 | 400 | 0.018 |

TABLE 6

| Extinguishment of n-Heptane Diffusion Flames CF3CHFC1/CF3CHFCF3 Mixtures | | | | | | | | |
|---|---|---|---|---|---|---|---|---|
| CF3CHFC1 | | CF3CHFC1 | CF3CHFCF3 | Total | CF3CHFC1 | CF3CHFCF3 | Total | |
| mol % | wt % | % added | % added | % added | mg/L | mg/L | mg/L | ODP |
| 0 | 0 | 0 | 6.1 | 6.1 | 0 | 421 | 421 | 0.000 |
| 22.3 | 18.7 | 1.1 | 4.0 | 5.1 | 63 | 274 | 337 | 0.004 |
| 42.6 | 37.3 | 2.4 | 3.3 | 5.7 | 136 | 228 | 364 | 0.008 |
| 62.9 | 57.5 | 3.7 | 2.2 | 5.9 | 205 | 151 | 356 | 0.011 |
| 80.7 | 77.0 | 4.9 | 1.2 | 6.1 | 271 | 81 | 352 | 0.015 |
| 93.8 | 92.4 | 6.0 | 0.4 | 6.4 | 334 | 27 | 361 | 0.017 |
| 100 | 100 | 7.2 | 0.0 | 7.2 | 400 | 0 | 400 | 0.018 |

TABLE 7

| Extinguishment of n-Heptane Diffusion Flames CF3CHFC1/CF4 Mixtures | | | | | | | | |
|---|---|---|---|---|---|---|---|---|
| CF3CHFC1 | | CF3CHFC1 | CF4 | Total | CF3CHFC1 | CF4 | Total | |
| mol % | wt % | % added | % added | % added | mg/L | mg/L | mg/L | ODP |
| 0 | 0 | 0 | 17.2 | 17.2 | 0 | 619 | 619 | 0.000 |
| 8.0 | 11.9 | 1.1 | 13.0 | 14.1 | 63 | 468 | 531 | 0.001 |
| 19.8 | 27.6 | 2.4 | 9.9 | 12.3 | 136 | 356 | 492 | 0.003 |
| 32.7 | 42.9 | 3.7 | 7.6 | 11.3 | 205 | 273 | 478 | 0.006 |
| 50.9 | 61.5 | 4.9 | 4.7 | 9.6 | 271 | 169 | 440 | 0.009 |
| 78.8 | 85.2 | 6.0 | 1.6 | 7.6 | 334 | 58 | 392 | 0.014 |
| 100 | 100 | 7.2 | 0.0 | 7.2 | 400 | 0 | 400 | 0.018 |

What is claimed is:

1. A method for extinguishing a fire which comprises the steps of:

a. introducing to the fire a fire extinguishing concentration of an extinguishant composition consisting of 2-Chloro-1,1,1,2-tetrafluoroethane and a second extinguishant selected from the group consisting of chloropentafluoroethane ($CF_3CF_2Cl$), heptafluoropropane ($CH_3CHFCF_3$), 1,1,1,3,3,3-hexafluoropropane ($CH_3CH_2CF_3$), 1,1,1,2,3,3-hexafluoropropane ($CF_3CHFCHF_2$, pentafluoroethane ($CF_3CHF_2$) and mixtures thereof; and b. maintaining the concentration of the composition until the fire is extinguished.

2. The method of claim 1 in which said composition consists of a mixture of 2-chloro-1,1,1,2-tetrafluoroethane and chloropentafluoroethane.

3. The method of claim 1 in which said composition consists of a mixture of 2-chloro-1,1,1,2-tetrafluoroethane and 1,1,1,3,3,3-hexafluoropropane.

4. The method of claim 1 in which said composition consists of a mixture of 2-chloro-1,1,1,2-tetrafluoroethane and 1,1,1,2,3,3-hexafluoropropane.

5. The method of claim 1 in which said composition consists of a mixture of 2-chloro-1,1,1,2-tetrafluoroethane and pentafluoroethane.

6. The method of claim 1 in which said composition consists of a mixture of 2-Chloro-1,1,1,2-tetrafluoroethane and $CF_3CHFCF_3$.

7. The method of claim 1 in which said introducing comprises combining the extinguishant composition with a propellant selected from nitrogen, carbon tetrafluoride or $CH_3H$ and propelling the extinguishant composition to the fire.

8. The method of claim 1 in which step a. comprises introducing a concentration of the composition of less than about 15% (v/v).

9. The method of claim 8 in which step a. comprises introducing a concentration of the composition of between about 3% and about 10% (v/v).

10. The method of claim 1 in which said introducing of step a. comprises introducing the composition through a total flooding system.

11. The method of claim 10 in which step a. comprises introducing a concentration of the composition of less than about 15% (v/v).

12. The method of claim 1 in which said introducing of step a. comprises introducing the composition through a portable extinguishing system.

* * * * *